US007261597B2

(12) United States Patent
Li

(10) Patent No.: US 7,261,597 B2
(45) Date of Patent: Aug. 28, 2007

(54) ELECTRICAL CONNECTOR WITH LOW PROFILE

(75) Inventor: Chao-Chang Li, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/444,072

(22) Filed: May 31, 2006

(65) Prior Publication Data

US 2006/0270274 A1 Nov. 30, 2006

(30) Foreign Application Priority Data

May 31, 2005 (CN) ..... 2005 2 0072290 U

(51) Int. Cl.
*H01R 21/44* (2006.01)

(52) U.S. Cl. ..... 439/607; 439/70; 439/680; 439/247

(58) Field of Classification Search ..... 439/607–609, 439/70–71, 680, 247
See application file for complete search history.

(56) References Cited

U.S. PATENT DOCUMENTS 6,905,344 B2 * 6/2005 Nishio et al. ..... 439/68
7,077,680 B1 * 7/2006 Wang et al. ..... 439/331
7,086,902 B1 * 8/2006 Yang ..... 439/607
2006/0189216 A1 * 8/2006 Yang ..... 439/680
2006/0258219 A1 * 11/2006 Chen ..... 439/607
2006/0270274 A1 * 11/2006 Li ..... 439/581
2006/0270276 A1 * 11/2006 Li ..... 439/607

* cited by examiner

*Primary Examiner*—Truc Nguyen
(74) *Attorney, Agent, or Firm*—Wei Te Chung

(57) ABSTRACT

An electrical connector (100) for accommodating an electrical device, and includes a shielding member (3), a terminal block positioned adjacent to the bottom of the shielding member (3), a number of terminals (2) received in the terminal block (1). The shielding member (3) includes a first wall (31), a second wall (32), a third wall (33) and a fourth wall (34) connecting with one another in turn, the terminal block (1) mainly extends along a first direction and is positioned adjacent to the bottom of the shielding member (3), the terminals (2) are assembled to the terminal block (1) and extends to a second direction perpendicular to the first direction. The terminal block (1) extends between the fist wall (31) and the third wall (33) of the shielding member (3) and engages with the first wall (31) and the third wall (33) of the shielding member (3) along the first direction without contact with the second wall (32) and fourth wall (34), the terminal block (1) comprises latch means (14), and the first wall (31) and third wall (33) respectively provide an engaging portion (312) corresponding to the latch means (14).

14 Claims, 5 Drawing Sheets

ELECTRICAL CONNECTOR WITH LOW PROFILE

BACKGROUND OF THE INVENTION

1. Field of the Invention

The present invention relates to an electrical connector, and particularly to an electrical connector used for a mobile phone or other electrical devices having different designs and configurations.

2. Description of the Prior Art

With the rapid development of the technology of wireless communication and advanced technology of electrics, electronic consuming products such as mobile phone, Personal Digital Assistant (PDA) etc., are designed to comply with miniaturization trend and multiple functions, such as mounting a camera thereon, to meet with requirements of human. As a result, socket connectors for accommodating the cameras therein are correspondingly demanded.

Usually, these electrical connectors used for accommodating and electrically connecting the cameras with the consuming products each provides an insulatvie housing, a shielding member assembled to the insulative housing, and a plurality of terminals engaged with the insulative housing. Please refer to FIG. 1, a conventional electrical connector 1' shown therein comprises a rectangular shielding member 30' defining a receiving space, an insulative housing 10' positioned on the bottom of the shielding member 30', and a plurality of terminals 20' assembled to receiving passageways 11' of an insulative housing 10' which is received in the bottom portion of the receiving space. Each wall of the shielding member 30' respectively defines a pair of locking barb 301' at two sides thereof, and the insulative housing 10' defines a plurality of locking slots 101' corresponding to the locking barbs 301'. In process of assembling the insulative housing 10' and the shielding member 30', the locking barbs 301' are insert into the locking slots 101', and then the tapered protrusions of the locking barbs 301' lock with the locking slots 101'. However, it requires the insulative housing have enough thickness to ensure the reliability of engagement with the shielding member 30' in this way. The insulative housing results in high profile of the connector along the mating direction, and thus increases the thickness of the consuming products. The insulative housing 10' even may disengage from the shielding member 30' when large force is exerted thereto and thus, damage the electrical connection. Furthermore, the large profile housing goes against the trend of cost down.

Hence, an improved electrical connector is desired to overcome the disadvantages of the prior art.

BRIEF SUMMARY OF THE INVENTION

Therefore, a main object of the present invention is to provide an electrical connector having low-profile.

To fulfill the above-mentioned object, an electrical connector for accommodating an electrical device, includes a shielding member, a terminal block positioned adjacent to the bottom of the shielding member, a number of terminals received in the terminal block. The shielding member comprises a first wall, a second wall, a third wall and a fourth wall connecting with one another in turn, the terminal block mainly extends along a first direction and is positioned adjacent to the bottom of the shielding member, the terminals are assembled to the terminal block and extends to a second direction perpendicular to the first direction. The terminal block extends between said fist wall and third wall of the shielding member and engages with the first wall and the third wall of the shielding member along the first direction without contact with the second wall and fourth wall, the terminal block comprises latch means, and the first wall and third wall respectively provide an engaging portion corresponding to the latch means.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
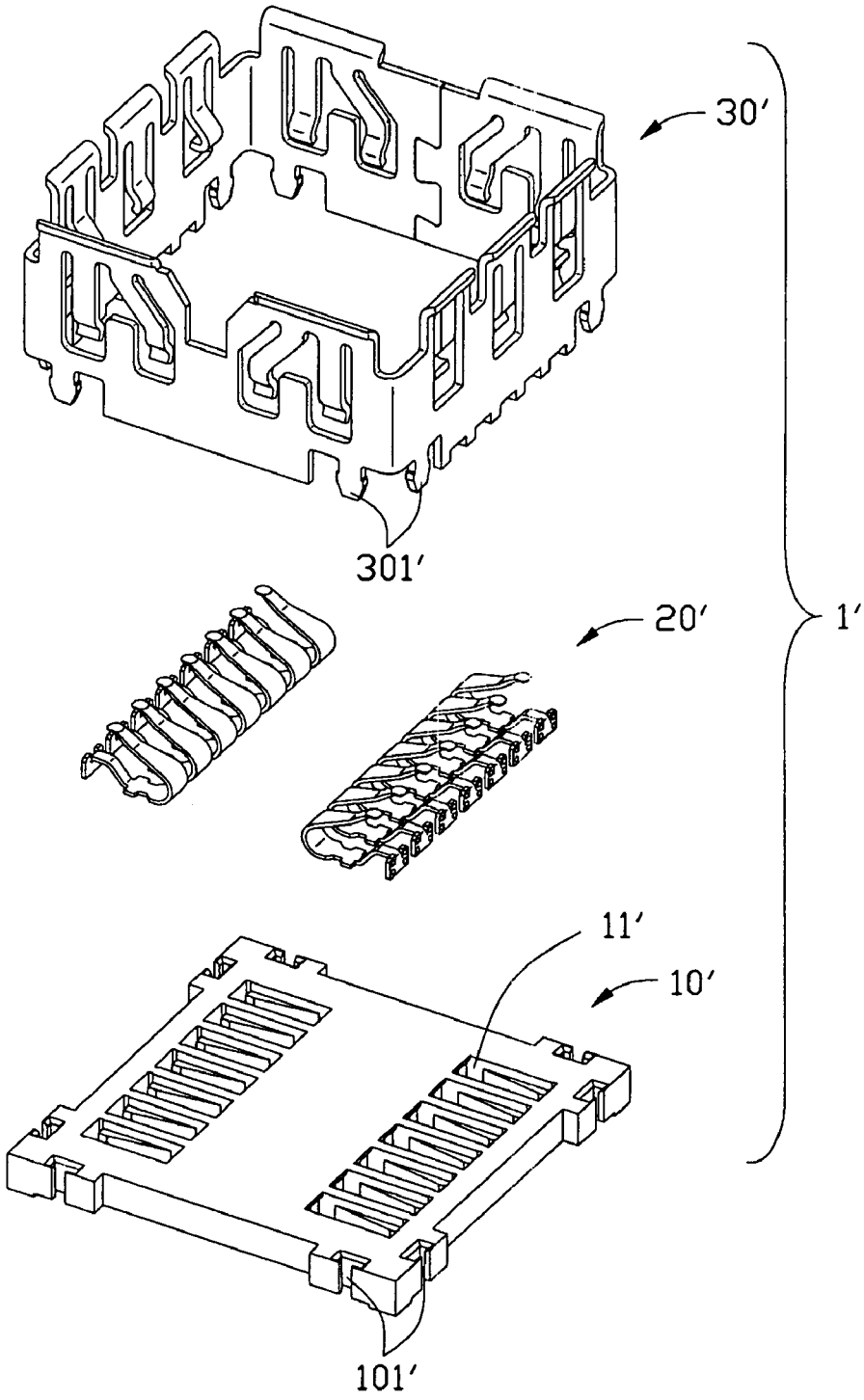
FIG. 1 (PRIOR ART)
FIG. 1 is an exploded view of a conventional electrical connector.
Figure 2:
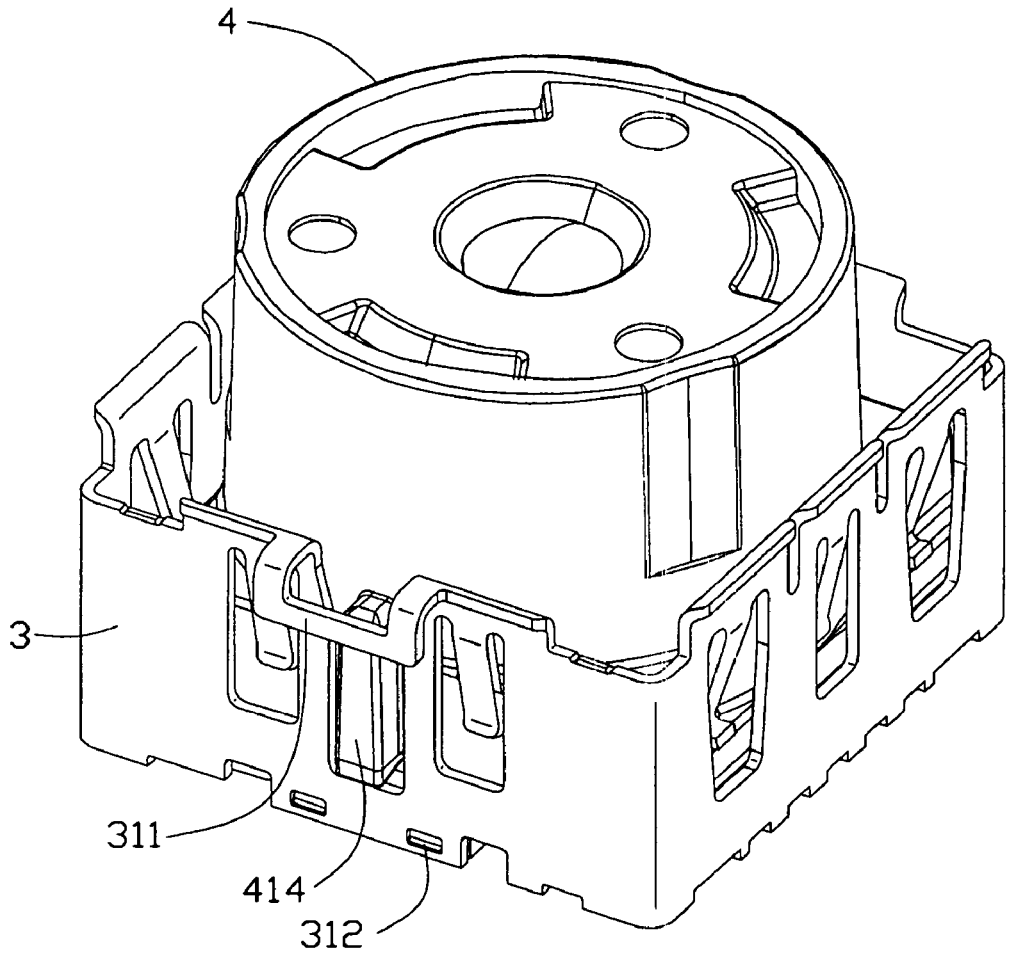
FIG. 2 is an assembled, perspective view of an electrical connector assembled with an electrical device according to the present invention.
Figure 3:
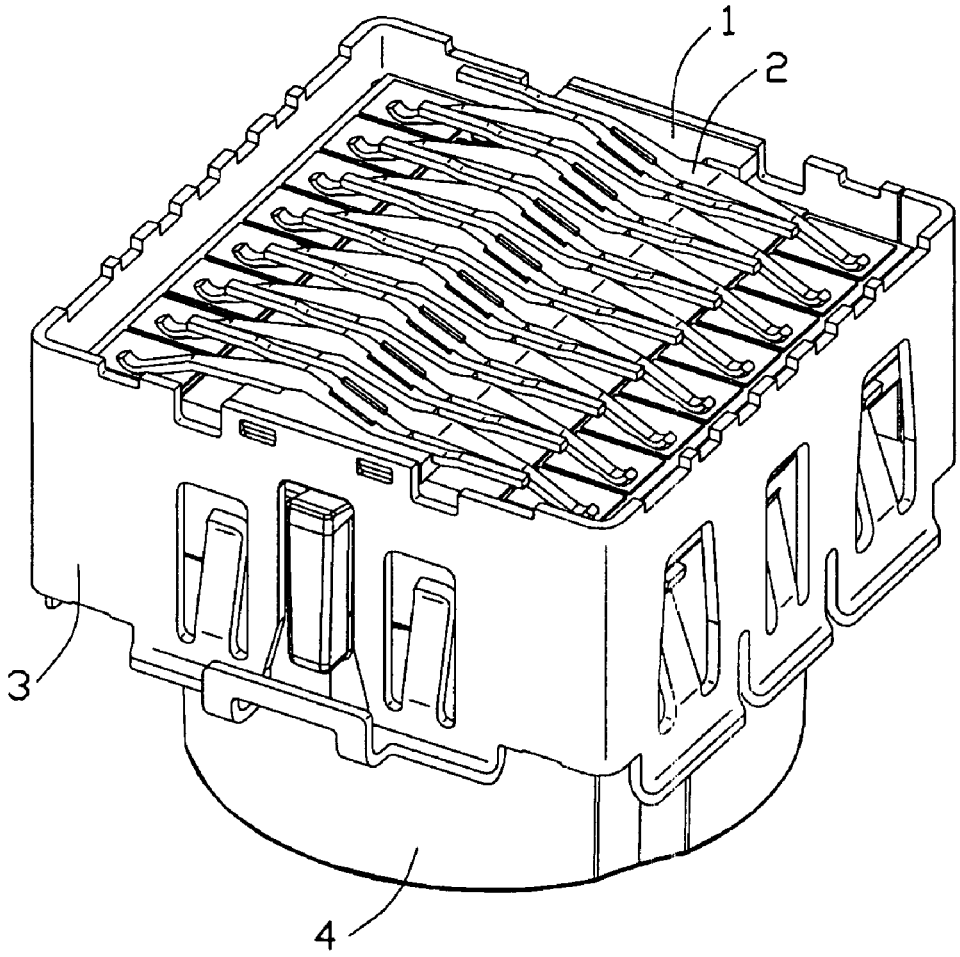
FIG. 3 is a view similar to FIG. 2, but viewed from another aspect.

Reference will now be made in detail to the preferred embodiment of the present invention.

Referring to FIGS. 2-5, an electrical connector 100 according to the present invention is adapted for receiving an electrical device which is a camera module 4 in the present embodiment. The electrical connector 100 comprises a shielding member 3 accommodating the camera module 4, a plurality of terminals 2 and an insert-molding terminal block 1. The terminal block 1 is positioned adjacent to the bottom of the shielding member 3.

The terminal block 1 dimensioned to receive the plurality of terminals 2 therein comprises a rectangular main body 11 extending along the longitudinal direction and a pair of side portions 13 respectively disposed at opposite ends of the main body 11. A plurality of recessed passageways 15 are spaced arranged along the longitudinal direction of the bottom surface of the main body 11. Each passageway 15 forms a heave 12 in the inner side thereof and each heave 12 is of irregular shape. Each side portion 13 comprises a pair of projections 14 spaced arranged on outer edge thereof along a lateral direction of the main body 11 for coupling with the shielding member 3.

Each terminal 2 is longitudinal shaped and mainly extends along the lateral direction of the terminal block 1, and comprises a soldering portion 21, a mating portion 23 and a middle portion 22 connecting with the soldering portion 21 and the mating portion 23. The mating portion 23 extends upwardly from the middle portion 22 and along a direction away from the middle portion 22, and forms a curved mating section 230 at a free end thereof. The soldering portion 21 extends slantwise and downwardly from the middle portion 22. A wedgy recess 220 is disposed on one side of the middle portion 22 to strength the engagement with the terminal block 1 after the terminal 2 insert-molded with the terminal block 1. Every adjacent two terminals 2 of the electrical connector 100 according to present invention are interlaced disposed with one terminal 2 having 180 degrees reverse relative to the other terminal 2. Thus, the recesses 220 of the neighboring terminals 2 are face to face to make sure that the terminals 2 can reliably engage with the terminal block 1 after insert-molding.

The shielding member 3 is firstly stamped from a metal sheet and then bent to form a rectangular configuration shown in the present invention. The shielding member 3 comprises a first wall 31, a second wall 32, a third wall 33, a fourth wall 34 which connect with one another in turn to form a receiving space 30. A swallow-tail shaped jointing line 300 is formed near the jointing portion of the third wall 33 and the fourth wall 34. The first wall 31 comprises a U-shape cutout 310 defined in a central section thereof and recessed downwardly from an upper edge thereof, a U-shaped connecting portion 311 protruding outwardly from the upper edge thereof and connecting to two opposite sides of the cutout 310. A pair of resilient tabs 313 are symmetrically located at two opposite sides of the cutout 310 respectively and bent inwardly into the receiving space 30. A pair of apertures 312 are defined in a low portion of the first wall 31 and a guide portion 314 curved outwardly from the upper edge of the first wall 31 and connects with the U-shaped connecting portion 311. The cutout 310 comprises a bottom edge 370 and the width of the top portion of the cutout 310 is slightly lager than that of the bottom edge 370. The U-shaped connecting portion 311 overcomes the limitation of the low intention caused by the cutout 310 located in the first wall 31, and furthermore the width of the first wall 31 is not increased since the connecting portion 311 is stamped from the first wall 31. The resilient tab 313 comprises a jointing portion 3130 connecting to the guide portion 314, a main portion 3131 connecting to the jointing portion 3130 and bent toward the third wall 33 of the shielding member 3 and a sustaining portion 3132 resisting against the camera module 4. The second and the fourth walls 32, 34 each comprises a resilient tab 313 located on the central section thereof having structure same as the resilient tab 313, a pair of clasping arms 320 symmetrically located at two sides of the resilient tab 313, and three guide portions 314 respectively connecting with the resilient tab 313 and the clasping arms 320. The third wall 33 comprises a pair of resilient tabs 313 corresponding to the resilient tabs 313 of the first wall 31, a pair of guide portions 314 connecting to the resilient tabs 313 and the pair of apertures 312 located in the low portion of the third wall 33 corresponding to a pair of apertures 312 of the first wall 31. The resilient tabs 313 of the four walls 31, 32, 33, 34 are capable of symmetrically fixing the camera module 4 and establish a grounding connection for the electrical connector 100. The clasping arms 320 of the walls 32, 34 are capable of reliably locking the camera module 4 within the shielding member 3. The guiding portion 314 can easily guide the camera module 4 to be assembled into the shielding member 3.

Figure 4:
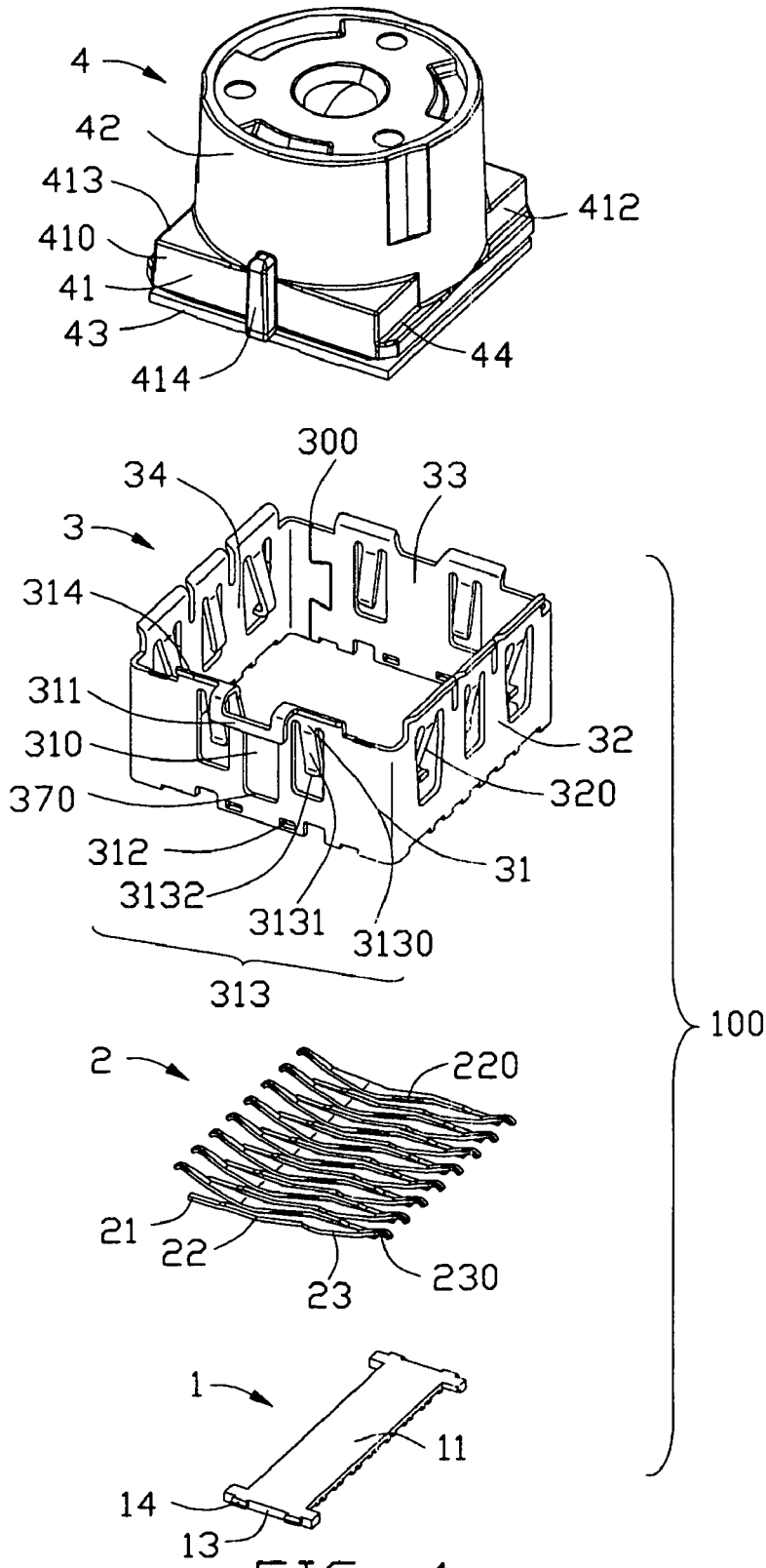
FIG. 4 is an exploded, perspective view of FIG. 2.

The camera module 4, received in the receiving space 30 of the shielding member 3, comprises a rectangular base portion 41, a columnar portion 42 situated on the top of the base portion 41 and a bottom portion 43 located beneath the base portion 41. The base portion 41 comprises a front wall 410, two side walls 412, 413 adjoined to the front wall 410, and a back wall (not labeled) opposite to the front wall 410. The side walls 412, 413 each defines a step-shaped clasping notch 44 for locking with the clasping arms 320. Referring to FIG. 4, the front wall 410 of the base portion 41 provides an approximately longitudinal nose 414 which may insert into the cutout 310. When the camera module 4 is shocked, the rib 414 abuts against the bottom edge 370 and is received in the U-shape region of the connecting portion 311, so the camera module 4 will not move downwardly. A conductive layer enclosed around the columnar portion 42 can establish an electrical connection with the resilient tabs 313 of the shielding member 3. The bottom surface of the bottom portion 43 has a plurality of conductive pads 431 along edges thereof for contacting with the mating sections 230 of the terminals 2.

Figure 5:
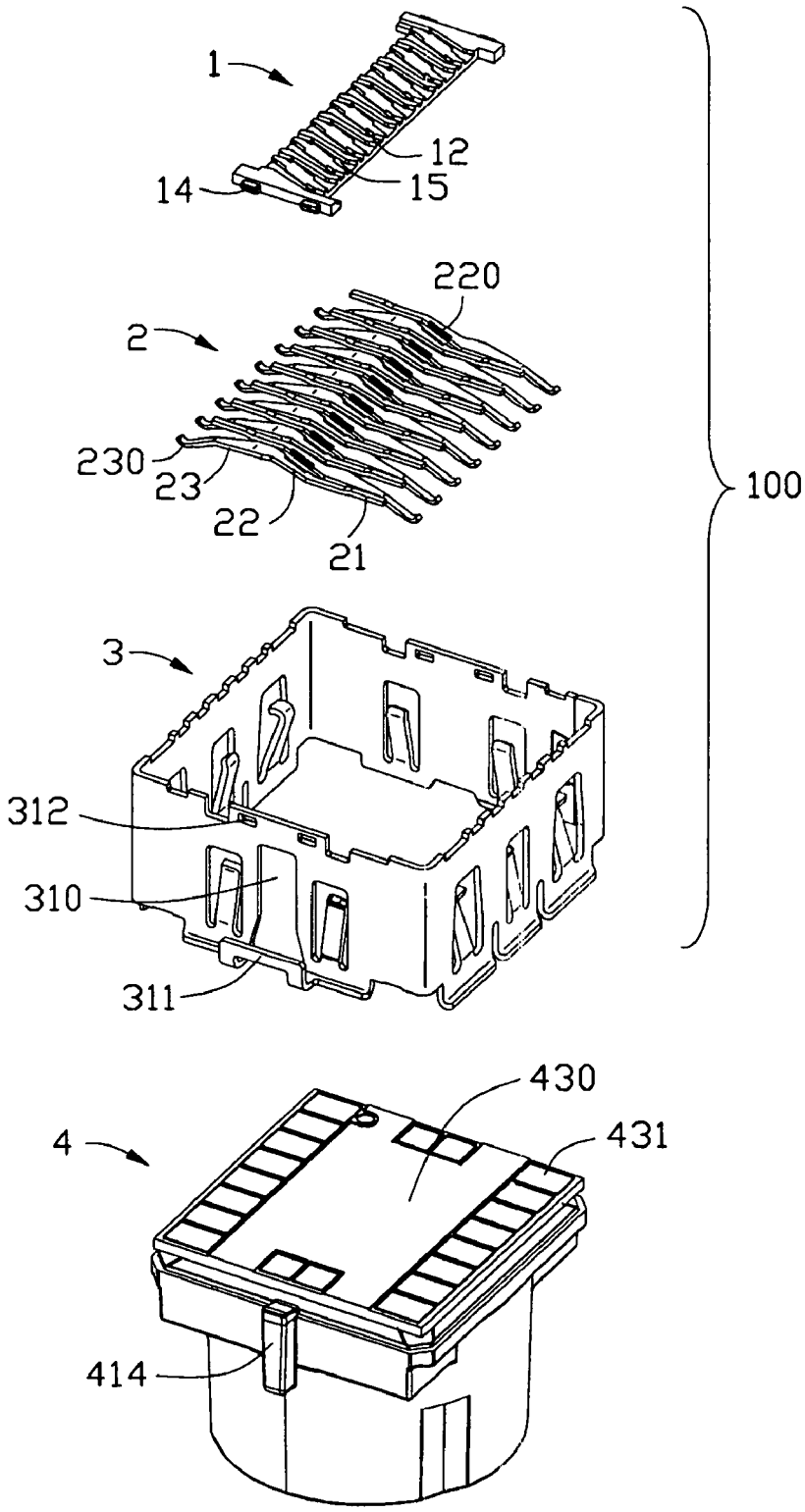
FIG. 5 is a view similar to FIG. 4, but viewed from another aspect.

In assembly, referring to FIGS. 4-5, firstly, the terminals 2 are arranged as described above in a mold, and then the melting plastic material flows between the space of the terminals 2. After cool, the terminal block 1 is formed, and the terminals 2 extend along the lateral direction perpendicular to the longitudinal direction of the main body 11 of the terminal block 1. Then, the terminal block 1 with the terminals 2 assembled therein is formed. The middle portions 21 of the terminals 2 are received in the passageways 15 of the terminal block 1. Then, the terminal block 1 with the terminals 2 is assembled to the shielding member 3 with the projections 14 of one side portion 13 of the terminal block 1 received in the apertures 312 defined on the bottom of the first wall 31, and then bending the walls 32, 33, 34 in turn to make sure that the projections 14 of the other side portion 13 engage with the apertures 312 of the third wall 33. After the terminal block 1 being assembled to the shielding member 3, the bottom of the terminal block 1 is about positioned in the same plane with the bottom edge of the shielding member 3. Then, the camera module 4 is inserted into the receiving space 30 of the shielding member 3 along a top-to-bottom direction. In the meanwhile, the nose 414 of the camera module 4 is pressed into the cutout 310 of the shielding member 3 with the pressure caused by the resilient tabs 313 and the clasping arms 320. In the process of moving downwardly, the rib 414 engages with the cutout 310. The resilient tabs 313 press against the outer periphery of the columnar portion 43, and the clasping arms 320 engage with the clasping notches 44. Thus, the camera module 4 is accommodated and supported by the shielding member 3, and avoids being moved towards the vertical direction by shock. After the camera module 4 is inserted, the conductive pads 431 of the bottom portion 43 of the camera module 4 electrically connect with the mating sections 230 of the mating portions 23 of the terminals 2 placed in the terminal block 1.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for accommodating an electrical device, comprising:

a shielding member defining a receiving space adapted for receiving said electrical device therein, and comprising a first wall, a second wall, a third wall and a fourth wall connecting with one another in turn;

a terminal block mainly extending along a first direction and positioned adjacent to a bottom portion of the shielding member;

a plurality of terminals assembled to the terminal block and each terminal extending in a second direction perpendicular to the first direction; and wherein said terminal block extends between said first wall and third wall of the shielding member and engages with the first wall and the third wall of the shielding member along said first direction, said terminal block comprises latch means, and said first wall and third wall respectively provide an engaging portion corresponding to the latch means;

wherein the first side wall comprise a cutout and a U-shaped connecting portion protruding outwardly and connecting to two opposite sides of the cutout;

wherein said terminal block does not contact with said second wall and fourth wall;

wherein the U-shaped connecting portion extending from a top portion opposite from the bottom portion and bending in a direction toward the bottom portion of the shielding member;

wherein the cutout receiving a protrusion on a side of the electrical device.

2. The electrical connector as described in claim 1, wherein the latch means has at least a pair of projections respectively formed at opposite sides of the terminal block along the first direction, the engaging portion has at least one aperture respectively located on the first wall and the third wall, said pair of projections are correspondingly received in said a pair of apertures.

3. The electrical connector as claimed in claim 1, wherein the terminal block comprises a main body and a pair of side portions located at two sides thereof, said latch means are formed on the side portions.

4. The electrical connector as claimed in claim 1, wherein the terminals are insert-molded with the terminal block.

5. The electrical connector as claimed in claim 1, wherein each terminal comprises a soldering portion, a mating portion and a middle portion connecting with the soldering portion and the mating portion, the soldering portions of the neighboring terminals are respectively located at two sides of the terminal block along the second direction.

6. The electrical connector as described in claim 1, wherein the middle portion of the terminal defines a recess, and the terminal block has a heave engaging with said recess.

7. The electrical connector as claimed in claim 1, wherein the first, the second, the third and the fourth walls each has at least a resilient tab adapted for pressing against the outer periphery of the electrical device.

8. The electrical connector as claimed in claim 1, wherein the first, the second, the third and the fourth walls each has a least a guide portion adapted for facilitating insertion of the electrical device.

9. The electrical connector as claimed in claim 1, wherein the second wall and the fourth wall each has at least a clamping arm adapted for prevent the electrical device from moving up by shock.

10. The electrical connector as claimed in claim 1, wherein the bottom of the terminal block is about positioned in the same plane with the bottom edge of the shielding member.

11. The electrical connector as described in claim 5, wherein said mating portion extends upwardly from the middle portion and along a direction away from the middle portion, and said soldering portion extends slantwise and downwardly from the middle portion.

12. The electrical connector as claimed in claim 6, wherein every set of neighboring adjacent terminals are interlaced disposed with a pair of recesses thereof facing to each other.

13. An electrical connector for accommodating an electrical device, comprising:

a shielding member defining a receiving space adapted for receiving said electrical device therein, and comprising a first wall, a second wall, a third wall and a fourth wall connecting with one another in turn;

a terminal block mainly positioned adjacent to a bottom portion of the shielding member;

a plurality of terminals assembled in the terminal block; and means for attaching said terminal block to the first and third walls of the shielding member in a floating manner in a vertical direction without a risk of dropping;

wherein the first side wall comprise a cutout and a U-shaped connecting portion protruding outwardly and connecting to two opposite sides of the cutout;

wherein said terminal block does not contact with said second wall and fourth wall;

wherein the U-shaped connecting portion extending from a top portion opposite from the bottom portion and bending in a direction toward the bottom portion of the shielding member;

wherein the cutout receiving a protrusion on a side of the electrical device.

14. The connector as claimed in claim 13, wherein said means includes an opening in one of the shielding member and the terminal block, and a protrusion on the other and received in the opening under a condition that a dimension of said opening is larger than that of the protrusion in the vertical direction.

* * * * *